US012729890B2

(12) United States Patent
Pyo

(10) Patent No.: US 12,729,890 B2
(45) Date of Patent: Sep. 8, 2026

(54) HEAT PUMP SYSTEM

(71) Applicant: SAMSUNG ELECTRONICS CO., LTD., Suwon-si (KR)

(72) Inventor: Soonjae Pyo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 44 days.

(21) Appl. No.: 18/736,015

(22) Filed: Jun. 6, 2024

(65) Prior Publication Data

US 2024/0318879 A1 Sep. 26, 2024

Related U.S. Application Data

(63) Continuation of application No. PCT/KR2022/018677, filed on Nov. 24, 2022.

(30) Foreign Application Priority Data

Jan. 17, 2022 (KR) ..... 10-2022-0006407

(51) Int. Cl.
*F25B 30/02* (2006.01)
*F25B 5/02* (2006.01)
(Continued)

(52) U.S. Cl.
CPC ..... *F25B 30/02* (2013.01); *F25B 5/02* (2013.01); *F25B 41/20* (2021.01); *F25B 41/31* (2021.01); *F25D 21/12* (2013.01)

(58) Field of Classification Search
CPC .. F25B 30/02; F25B 5/02; F25B 41/20; F25B 41/31; F25B 47/022; F25B 2313/003;
(Continued)

(56) References Cited

U.S. PATENT DOCUMENTS 5,839,292 A 11/1998 Hwang
8,839,636 B2 9/2014 Hamada et al.
9,714,769 B2 7/2017 Choi

FOREIGN PATENT DOCUMENTS

CN 1344896 A * 4/2002
CN 202734233 U * 2/2013
(Continued)

OTHER PUBLICATIONS

International Search Report for PCT/KR2022/018677 mailed Mar. 21, 2023, 4 pages.
(Continued)

*Primary Examiner* — Kun Kai Ma
(74) *Attorney, Agent, or Firm* — Nixon & Vanderhye P.C.

(57) ABSTRACT

A heat pump system in which a heat source is air, and may include: a compressor configured to compress a refrigerant, a first heat exchanger configured to exchange heat between the refrigerant and air, a second heat exchanger configured to exchange heat between the refrigerant and water, a first refrigerant pipe configured to discharge the refrigerant heat exchanged in the first heat exchanger during a defrosting operation for the first heat exchanger, and a second refrigerant pipe configured to guide the refrigerant from the first refrigerant pipe to the second heat exchanger. The heat pump system may further include: a third refrigerant pipe configured to discharge the refrigerant heat exchanged in the second heat exchanger after flowing into the second heat exchanger through the second refrigerant pipe, a first water pipe configured to supply water to be heat exchanged in the second heat exchanger, a second water pipe configured to return the water heat exchanged in the second heat exchanger, a bypass pipe connecting the first refrigerant pipe and the third refrigerant pipe and configured to bypass the second heat exchanger, and a third heat exchanger config-
(Continued)

ured to heat exchange the refrigerant guided by the bypass pipe with the water flowing in the second water pipe, during the defrosting operation.

20 Claims, 8 Drawing Sheets

(51) Int. Cl.
*F25B 41/20* (2021.01)
*F25B 41/31* (2021.01)
*F25D 21/12* (2006.01)

(58) Field of Classification Search
CPC ..... F25B 2313/0232; F25B 2313/0234; F25B 2400/0411; F25B 47/025; F25B 13/00; F25B 49/02; F25B 25/005; F24D 2200/123; F24D 11/0214; F24D 19/0095; F24D 3/18; F24D 19/1039; F24H 15/136
See application file for complete search history.

(56) References Cited

FOREIGN PATENT DOCUMENTS

| | | | | | |
|---|---|---|---|---|---|
| CN | 105509363 | A | * | 4/2016 | ..... F24D 12/02 |
| CN | 110631291 | A | * | 12/2019 | ..... F25B 30/06 |
| EP | 2725305 | A2 | * | 4/2014 | ..... F25B 47/025 |
| EP | 2853838 | A1 | * | 4/2015 | ..... F25B 47/025 |
| EP | 2990737 | B1 | | 5/2018 | |
| JP | 2004309044 | A | * | 11/2004 | |
| JP | 2005241091 | A | * | 9/2005 | |
| JP | 3901192 | B2 | | 4/2007 | |
| JP | 4078036 | B2 | | 2/2008 | |
| JP | 2010091131 | A | | 4/2010 | |
| JP | 5590087 | B2 | | 8/2014 | |
| JP | 2016023921 | A | | 2/2016 | |
| JP | 5924930 | B2 | | 4/2016 | |
| JP | 5978099 | B2 | | 7/2016 | |
| JP | 2017062075 | A | * | 3/2017 | |
| JP | 6142711 | B2 | | 5/2017 | |
| JP | 6398324 | B2 | | 9/2018 | |
| KR | 19980017695 | A | | 6/1998 | |
| KR | 10-2011-0091390 | A | | 8/2011 | |
| KR | 101641248 | B1 | | 7/2016 | |
| KR | 20170055678 | A | | 5/2017 | |
| KR | 101980710 | B1 | | 5/2019 | |
| WO | 2021172868 | A1 | | 9/2021 | |

OTHER PUBLICATIONS

Written Opinion of the ISA for PCT/KR2022/018677, mailed Mar. 21, 2023, 4 pages.
Extended European Search Report dated Jan. 28, 2025 issued in European Patent Application No. 22920788.1.
Korean Office Action dated Apr. 29, 2026 issued in Korean Patent Application No. 10-2022-0006407 and English translation, 15 pp.

* cited by examiner

HEAT PUMP SYSTEM

CROSS-REFERENCE TO RELATED APPLICATIONS

This application is a continuation of International Application No. PCT/KR2022/018677, designating the United States, filed on Nov. 24, 2022, in the Korean Intellectual Property Receiving Office and claiming priority to Korean Patent Application No. 10-2022-0006407, filed on Jan. 17, 2022, in the Korean Intellectual Property Office, the disclosures of each of which are incorporated by reference herein in their entireties.

BACKGROUND

Field

The disclosure relates to a heat pump system, and for example, to an air-to-water (ATW) heat pump system in which external air is a heat source.

Description of Related Art

In general, a heat pump system includes a refrigerant cycle including a compressor, an expansion device, an outdoor heat exchanger, and a refrigerant pipe, and a water system cycle including a terminal such as a radiator, a buffer tank, a backup heater, and a water pipe.

The refrigerant cycle, which absorbs heat from external air, may transfer heat to the water system cycle. The refrigerant cycle may be arranged with a finned tube heat exchanger, which is an outdoor heat exchanger capable of exchanging heat with external air. A plate heat exchanger capable of exchanging heat may be disposed between the refrigerant cycle and the water system cycle.

In an outdoor heat exchanger, frosting, which is a phenomenon where water vapor condenses and freezes and adheres to a surface of a refrigerant pipe, may occur, and to prevent or reduce such frosting, a heat pump system may require a defrosting operation. In this case, low pressure and low temperature refrigerant may flow into a plate heat exchanger during the defrosting operation, causing freezing.

SUMMARY

Embodiments of the disclosure provide a heat pump system including a structure that prevents and/or reduces low temperature and low pressure refrigerant from flowing into a plate heat exchanger during a defrosting operation.

Embodiments of the disclosure provide a heat pump system including a coil type heat exchanger capable of bypassing a plate heat exchanger during a defrosting operation to heat exchange refrigerant with water flowing in a water pipe to obtain the amount of heat required for defrosting.

According to an example embodiment of the disclosure, a heat pump system may include: a compressor configured to compress a refrigerant, a first heat exchanger configured to exchange heat between the refrigerant and air, a second heat exchanger configured to exchange heat between the refrigerant and water, a first refrigerant pipe configured to discharge the refrigerant heat exchanged in the first heat exchanger during a defrosting operation for the first heat exchanger, a second refrigerant pipe configured to guide the refrigerant from the first refrigerant pipe to the second heat exchanger, a third refrigerant pipe configured to discharge the refrigerant heat exchanged in the second heat exchanger after flowing into the second heat exchanger through the second refrigerant pipe, a first water pipe configured to supply water to be heat exchanged in the second heat exchanger, a second water pipe configured to return the water heat exchanged in the second heat exchanger, a bypass pipe connecting the first refrigerant pipe and the third refrigerant pipe to bypass the second heat exchanger, and a third heat exchanger configured to heat exchange the refrigerant guided by the bypass pipe with the water flowing in the second water pipe, during the defrosting operation.

The heat pump system may further include a fourth refrigerant pipe connected to the bypass pipe on one side thereof, and configured to allow the refrigerant heat exchanged by the third heat exchanger to be moved to the compressor side.

The third refrigerant pipe may be connected to the fourth refrigerant pipe on an upstream side of the third heat exchanger and configured to allow the refrigerant discharged from the third refrigerant pipe to pass through the third heat exchanger.

The heat pump system may further include a capillary tube disposed in the bypass pipe and configured to expand the refrigerant flowing in the bypass pipe, and an opening/closing valve configured to open and close the bypass pipe.

The opening/closing valve may be disposed on an upstream side of the capillary tube with respect to a direction of movement of the refrigerant flowing in the bypass pipe.

The opening/closing valve may include a solenoid valve.

The heat pump system may further include: an expansion valve configured to expand the refrigerant flowing in the second refrigerant pipe and capable of opening and closing the second refrigerant pipe, wherein the bypass pipe may have a first end connected to the first refrigerant pipe between the first heat exchanger and the expansion valve, and a second end connected to the third refrigerant pipe and the fourth refrigerant between the second heat exchanger and the third heat exchanger.

The heat pump system may further include a capillary tube provided in the first refrigerant pipe.

The third heat exchanger may include a coil type heat exchanger surrounding an outer circumference of the second water pipe.

The heat pump system may be capable of performing different defrosting modes based on the temperature of the water flowing in the first water pipe.

A bypass defrosting mode may be performed based on the temperature of the water flowing in the first water pipe being lower than a specified temperature, wherein in the bypass defrosting mode, the refrigerant in the first refrigerant pipe may be directed to the third heat exchanger through the bypass pipe.

In the bypass defrosting mode, the second refrigerant pipe may be closed and the refrigerant in the bypass pipe may be expanded by a capillary tube.

A normal defrosting mode may be performed based on the temperature of the water flowing in the first water pipe being greater than a specified temperature, and in the normal defrosting mode, the refrigerant in the first refrigerant pipe may be directed to the second heat exchanger through the second refrigerant pipe.

In the normal defrosting mode, the bypass pipe may be closed and the refrigerant in the second refrigerant pipe may be expanded by an expansion valve.

The first heat exchanger may include a finned tube heat exchanger, and the second heat exchanger may include a plate heat exchanger.

According to an example embodiment of the disclosure, a heat pump system may include: a compressor configured to compress a refrigerant, a first heat exchanger configured to exchange heat between the refrigerant and air, a second heat exchanger configured to exchange heat between the refrigerant heat exchanged by the first heat exchanger and water, a first water pipe configured to guide water to heat exchange in the second heat exchanger, a second water pipe configured to guide the water heat exchanged in the second heat exchanger to the outside, a first refrigerant pipe configured to discharge the refrigerant heat exchanged in the first heat exchanger during a defrosting operation for the first heat exchanger, a second refrigerant pipe connected to the first refrigerant pipe and configured to guide the refrigerant in the first refrigerant pipe to the second heat exchanger, a third refrigerant pipe configured to discharge the refrigerant heat exchanged in the second heat exchanger, a bypass pipe having a first end connected to the first refrigerant pipe and a second end connected to the third refrigerant pipe and configured to bypass the second heat exchanger, and a fourth refrigerant pipe connected to the second end of the bypass pipe and including a third heat exchanger configured to exchange heat with the water flowing in the second water pipe, wherein the refrigerant flowing in the first refrigerant pipe is guided to the second refrigerant pipe or the bypass pipe.

The heat pump system may further include a capillary tube disposed in the bypass pipe and configured to expand the refrigerant flowing in the bypass pipe, and an opening/closing valve configured to open and close the bypass pipe.

The heat pump system may further include: an expansion valve configured to expand the refrigerant flowing in the second refrigerant pipe and capable of opening and closing the second refrigerant pipe, wherein the first end of the bypass pipe is connected to the first refrigerant pipe between the first heat exchanger and the expansion valve, and the second end thereof is connected to the third refrigerant pipe and the fourth refrigerant between the second heat exchanger and the third heat exchanger.

The third heat exchanger may include a coil heat exchanger surrounding an outer circumference of the second water pipe.

According to an example embodiment of the disclosure, a heat pump system may include: a compressor configured to compress a refrigerant, a first heat exchanger configured to heat exchange between the refrigerant and air, a second heat exchanger configured to heat exchange between the refrigerant and water, a first refrigerant pipe configured to discharge the refrigerant heat exchanged in the first heat exchanger during a defrosting operation for the first heat exchanger, a second refrigerant pipe configured to guide the refrigerant from the first refrigerant pipe to the second heat exchanger, a third refrigerant pipe configured to discharge the refrigerant heat exchanged in the second heat exchanger, an expansion valve configured to expand the refrigerant flowing in the second refrigerant pipe and to open and close the second refrigerant pipe, a first water pipe configured to supply water to be heat exchanged in the second heat exchanger, a second water pipe configured to return the water heat exchanged in the second heat exchanger, a third heat exchanger configured to exchange heat between the refrigerant with the water flowing in the second water pipe, and a bypass pipe connecting the first refrigerant pipe and the third refrigerant pipe and configured to bypass the second heat exchanger and guide the refrigerant heat exchanged by the first heat exchanger to the third heat exchanger side.

According to various example embodiments of the present disclosure, the heat pump system including a structure capable of bypassing the plate heat exchanger configured to heat exchange water and refrigerant during the defrosting operation may be provided.

According to various example embodiments of the present disclosure, the heat pump system including a coil type heat exchanger configured to heat exchange water and refrigerant, separately from the plate heat exchanger, to obtain the amount of heat required for defrosting during the defrosting operation may be provided.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
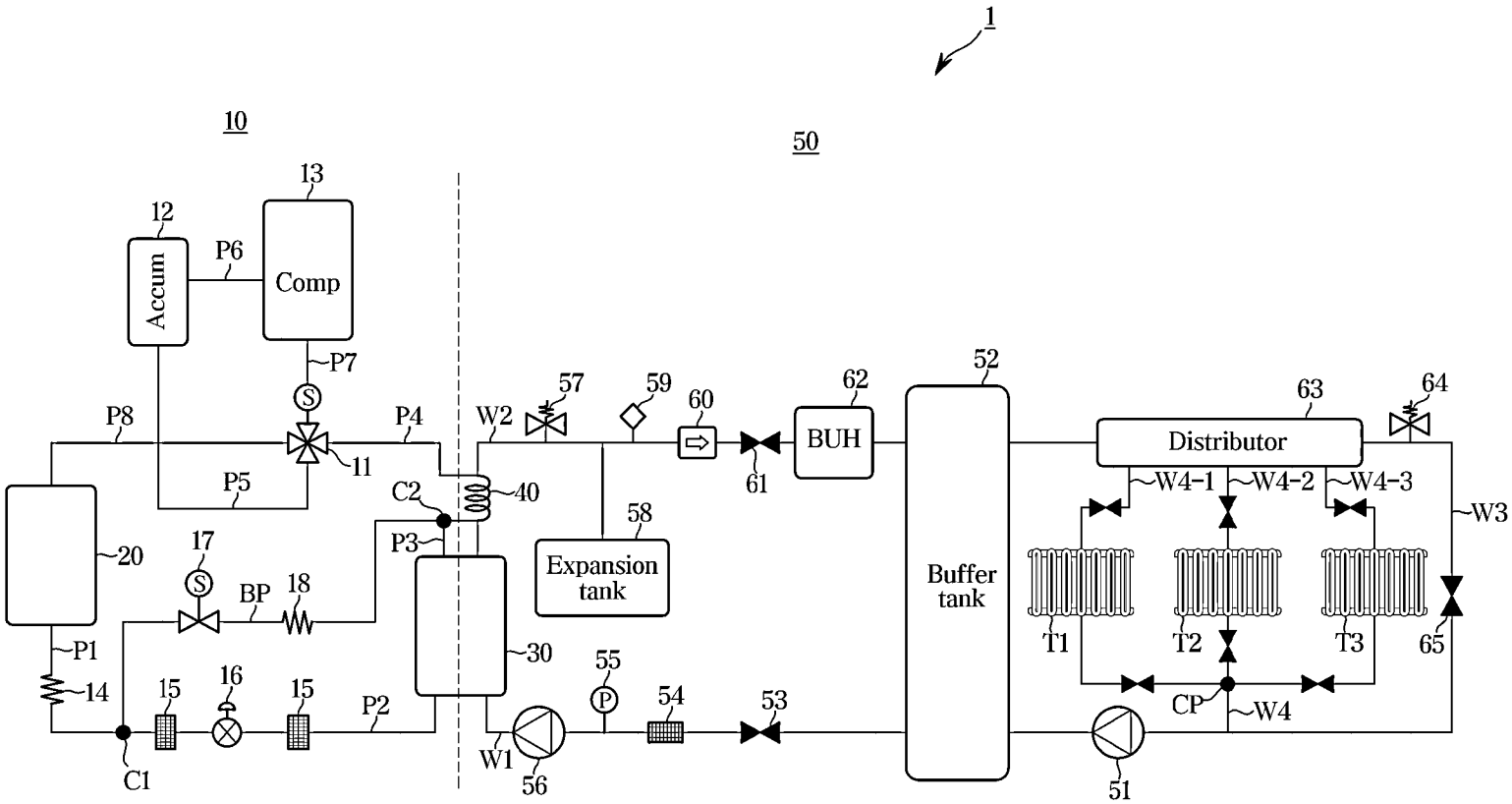
FIG. 1 is a diagram illustrating an example configuration of a heat pump system according to various embodiments.

Embodiments described in the disclosure and configurations shown in the drawings are merely examples of various example embodiments of the disclosure and may be used in various different ways at the time of filing of the present application.

In addition, the same reference numerals or signs shown in the drawings of the disclosure indicate like elements or components performing substantially the same function.

The terms used herein are used to describe the various example embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, figures, steps, operations, elements, components, or combinations thereof, but do not preclude the presence or addition of one or more of the features, figures, steps, operations, elements, components, or combinations thereof.

It will be understood that, although the terms "first", "second", "primary", "secondary", etc., may be used herein to describe various elements, but elements are not limited by these terms. These terms are simply used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Hereinafter, various example embodiments according to the disclosure will be described in greater detail with reference to the accompanying drawings.

FIG. 1 is a diagram illustrating an example configuration of a heat pump system 1 according to various embodiments. Referring to FIG. 1, the heat pump system 1 may include an outdoor unit (not shown) located in an outdoor space, and heat load units T1, T2, and T3 located in a space or device requiring cold or hot air. The heat pump system 1 may include an intermediate unit (not shown) that allows cold and hot air generated by the outdoor unit to be distributed to the heat load units T1, T2, and T3.

The heat pump system 1 may include a refrigerant cycle 10 flowing in the outdoor unit and a water system cycle 50 through which water that exchanges heat with the refrigerant of the refrigerant cycle 10 flows. The water heat exchanged with the refrigerant of the refrigerant cycle 10 may be supplied to the heat load units T1, T2, and T3. The heat load units T1, T2, and T3 may be terminals, and the terminal may include a radiator or the like.

The outdoor unit may operate with refrigerant heat exchanged with external air as its heat source, and may supply cold or hot air to the heat load units T1, T2, and T3 via the intermediate unit. The outdoor units may be located in an outdoor spaces, for example, on a roof or veranda of a building.

The refrigerant cycle 10, through which the refrigerant in the outdoor unit flows, and the water system cycle 50, through which the water heat exchanged with the refrigerant of the refrigerant cycle 10 flows, may be arranged adjacent to each other or in separate spaces. The refrigerant cycle 10 and the water system cycle 50 may be heat exchanged with each other via a second heat exchanger 30 and a third heat exchanger 40.

The heat pump system 1 may perform a cooling mode of delivering cold water to the heat load units T1, T2, and T3 or a heating mode of delivering hot water to the heat load units T1, T2, and T3, depending on the purpose. The heat pump system 1 may be an air-to-water (ATW) heat pump system that obtains a heat source from a first heat exchanger 20, which exchanges heat with external air, and transfers heat to water via the second heat exchanger 30 and the third heat exchanger 40.

The heat pump system 1 may be operated in a defrosting mode to prevent and/or reduce frost formation that may occur in the first heat exchanger 20, which is an outdoor heat exchanger. In the defrosting mode, high pressure and high temperature refrigerant may be provided to flow into the first heat exchanger 20.

The refrigerant cycle 10 may be a closed cycle in which a refrigerant flows. The refrigerant cycle 10 may include a compressor 13 arranged to compress the refrigerant, and an accumulator 12 arranged adjacent to the compressor 13 to accumulate a certain amount of refrigerant and then release the refrigerant to the compressor 13 side as needed.

The refrigerant cycle 10 may include the first heat exchanger 20 configured to heat exchange refrigerant with external air. The first heat exchanger 20 may be a finned tube type heat exchanger 20. The refrigerant cycle 10 may include the second heat exchanger 30 configured to heat exchange refrigerant flowing in the refrigerant cycle 10 with water flowing in the water system cycle 50. The second heat exchanger 30 may be a plate heat exchanger 30. In addition, the refrigerant cycle 10 may include, separately from the second heat exchanger 30, the third heat exchanger 40 configured to heat exchange the water and refrigerant of the water system cycle 50. The third heat exchanger 40 may be a coil type heat exchanger 40.

The first heat exchanger 20 and the second heat exchanger 30 may be connected by a first refrigerant pipe P1 and a second refrigerant pipe P2. In a defrosting operation, the refrigerant that has been heat exchanged with air, which is an external heat source, in the first heat exchanger 20 may be discharged through the first refrigerant pipe P1. The second refrigerant pipe P2 may be connected with the first refrigerant pipe P1 and may allow the refrigerant discharged from the first heat exchanger 20 to flow into the second heat exchanger 30 through the first refrigerant pipe P1.

The refrigerant cycle 10 may include a third refrigerant pipe P3 to which the refrigerant heat exchanged with the water flowing in the water system cycle 50 in the second heat exchanger 30 is discharged. A fourth refrigerant pipe P4 may be connected to the third refrigerant pipe P3 to allow the refrigerant to flow towards the accumulator 12 and the compressor 13 side. A four-way valve 11 may be disposed on one side of the fourth refrigerant pipe P4. The four-way valve 11 may switch a flow path of the refrigerant flowing in the fourth refrigerant pipe P4 and/or a flow path of the refrigerant discharged from the compressor 13. In addition, the four-way valve 11 may switch a direction of a flow path of the heat exchanged refrigerant flowing in the second heat exchanger 20 even in a cooling operation.

The four-way valve 11 and the accumulator 12 may be connected by a fifth refrigerant pipe P5. The accumulator 12 and the compressor 13 may be connected by a sixth refrigerant pipe P6. The sixth refrigerant pipe P6 may allow refrigerant to flow from the accumulator 12 side to the compressor 13 side. A seventh refrigerant pipe P7 may be disposed between the compressor 13 and the four-way valve 11, and an eighth refrigerant pipe P8 may be disposed between the four-way valve 11 and the second heat exchanger 20.

In other words, the four-way valve 11 may be connected to the fourth refrigerant pipe P4, the fifth refrigerant pipe P5, the seventh refrigerant pipe P7, and the eighth refrigerant pipe P8 to switch the direction of each flow path.

A first capillary tube 14 may be disposed on the first refrigerant pipe P1, and the first capillary tube 14 may improve the branching of the refrigerant flowing in the first refrigerant pipe P1. More particularly, a plurality of refrigerant pipes may be arranged within the first heat exchanger 20, and the branching of the refrigerant discharged from the plurality of refrigerant pipes may be improved by the first capillary tube 14. Furthermore, the first capillary tube 14 may expand the refrigerant flowing in the first refrigerant pipe P1.

The second refrigerant pipe P2 may be provided with an expansion valve 16 arranged to open or close the second refrigerant pipe P2 by expanding the refrigerant flowing in the second refrigerant pipe P2. The expansion valve 16 may be an electronic expansion valve (EEV).

A pair of strainers 15 may be disposed before and after the expansion valve 16 with respect to the flow direction of the second refrigerant pipe P2. The strainers 15 may be devices for filtering bulky substances flowing in the second refrigerant pipe P2.

The refrigerant cycle 10 may include a bypass pipe BP connecting the first refrigerant pipe P1 and the third refrigerant pipe P3 to bypass the second heat exchanger 30. A first end C1 of the bypass pipe BP may be connected to the first refrigerant pipe P1 between the first heat exchanger 20 and the expansion valve 16, and a second end C2 thereof may be connected to the third refrigerant pipe P3.

An opening/closing valve 17 for opening or closing the bypass pipe BP and a second capillary tube 18 for expanding the refrigerant flowing in the bypass pipe BP may be arranged in the bypass pipe BP. The opening/closing valve 17 may be disposed on an upstream side of the second capillary tube 18 with respect to the direction of the refrigerant flowing in the bypass pipe BP. The opening/closing valve 17 may be a solenoid valve 17.

One side of the fourth refrigerant pipe P4 may be connected to the bypass pipe BP, and the other side of the fourth refrigerant pipe P4 may be connected to the four-way valve 11. The fourth refrigerant pipe P4 may allow the refrigerant heat exchanged by the third heat exchanger 40 to be moved to the compressor 13 side, and may allow the refrigerant compressed by the compressor 13 to be moved to the third heat exchanger 40.

The third refrigerant pipe P3 may be connected to the fourth refrigerant pipe P4 to allow the refrigerant heat exchanged by the second heat exchanger 30 to pass through the third heat exchanger 40. In other words, the third refrigerant pipe P3 may be connected to the bypass pipe BP and the fourth refrigerant pipe P4 at the second end C2 of the bypass pipe BP.

The water system cycle 50 may include a first water pipe W1 for supplying water to the second heat exchanger 30 for heat exchange in the second heat exchanger 30, and a second water pipe W2 for returning the heat exchanged water from the second heat exchanger 30. The second water pipe W2 may supply water discharged from the second heat exchanger 30 to the heat load units T1, T2, and T3.

The second water pipe W2, apart from the second heat exchanger 30, may be in contact with the third heat exchanger 40 where the refrigerant and water of the refrigerant cycle 10 are heat exchanged. A portion of the fourth refrigerant pipe (P4) may be arranged to surround an outer circumference 80 (see FIG. 5) of the second water pipe W2.

The second water pipe W2 may be provided with a first safety valve 57, an expansion tank 58, and an air vent 59. The first safety valve 57 may be a hydraulic safety device arranged to open or close the second water pipe W2. The expansion tank 58 may absorb a volume that changes depending on the rising and falling liquid temperature in the second water pipe W2. The expansion tank 58 may absorb the changing volume of water in the second water pipe W2 to prevent and/or reduce overflow or air intrusion. The air vent 59 may be a device that allows the amount of air that may be in the second water pipe W2 to be drawn out of the outside of the second water pipe W2.

The water system cycle 50 may include a flow sensor 60 that measures a flow rate of water flowing in the second water pipe W2, and a first valve 61 that is operable to open or close the second water pipe W2 by the flow sensor 60. On a downstream side of the first valve 61 with respect to the flow direction of water flowing in the second water pipe W2, an electric heater 62 (also referred to as BUH) as an auxiliary heat source and a buffer tank 52, which acts as a buffer of pressure and temperature may be disposed.

The BUH 62 may be disposed in the second water pipe W2 to serve as a heat source during emergency use, and may additionally be a device for enhancing the heating performance for the heat load units T1, T2, and T3.

The water flowing in the second water pipe W2 after passing through the BUH 62 and the buffer tank 52 may be distributed by a distributor 63. A portion of the water passing through the distributor 63 may be distributed to the heat load units T1, T2, and T3. The heat load units T1, T2, and T3 may include the first heat load unit T1, the second heat load unit T2, and the third heat load unit T3. A portion of the water passing through the distributor 63 may be guided to the first heat load unit T1 by a first branch pipe W4-1 of a fourth water pipe W4. Similarly, a portion of the water flowing in the second water pipe W2 may be distributed to the second heat load unit T2 and the third heat load unit T3 by a second branch pipe W4-2 and a third branch pipe W4-3 of the fourth water pipe W4, respectively.

The first branch pipe W4-1, the second branch pipe W4-2, and the third branch pipe W4-3 of the fourth water pipe W4 may meet each other at a connection point (CP) and be connected to the fourth water pipe W4. In other words, the first branch pipe W4-1 to the third branch pipe W4-3 may supply water to the first heat load unit T1 to the third heat load unit T3, respectively, and may return water used in the first heat load unit Tl to the third heat load unit T3.

The remaining water distributed by the distributor 63 may pass through a third water pipe W3 and be guided to the first water pipe W1. The third water pipe W3 may be provided with a second safety valve 64 corresponding to the first safety valve 57. In addition, a second valve 65 for opening or closing the third water pipe W3 may be disposed in the third water pipe W3.

The fourth water pipe W4 and the third water pipe W3 may be connected to the first water pipe W1. The water flowing in the fourth water pipe W4 and the third water pipe W3 may be guided to the first water pipe W1.

The first water pipe W1 through which the water pumped by a first pump 51 flows may be opened or closed by a third valve 53. In addition, the first water pipe W1 through which the water passing through the third valve 53 flows may include a strainer 54 provided to filter out bulky foreign substances in the first water pipe W1.

The water system cycle 50 may include a manometer 55 that measures the pressure in the first water pipe W1 through which the water filtered out foreign substances flows, and a second pump 56 that supplies water, which heat exchanged with the refrigerate at the second heat exchanger 30 side , to the second heat exchange 30. The manometer 55 may be disposed on an upstream side with respect to the direction of flow of the water than the second pump 56.

Figure 2:
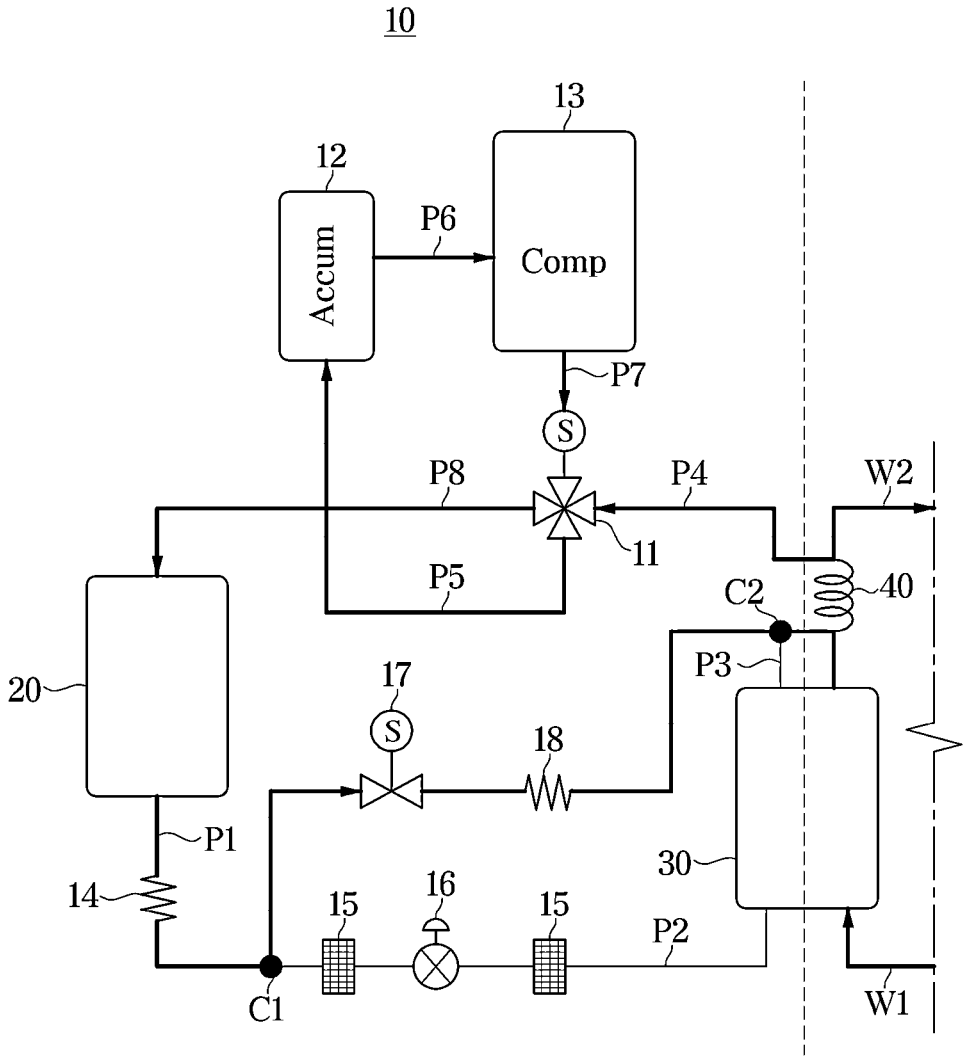
FIG. 2 is a diagram illustrating a flow of refrigerant in the heat pump system during a bypass defrosting mode, according to various embodiments.
Figure 3:
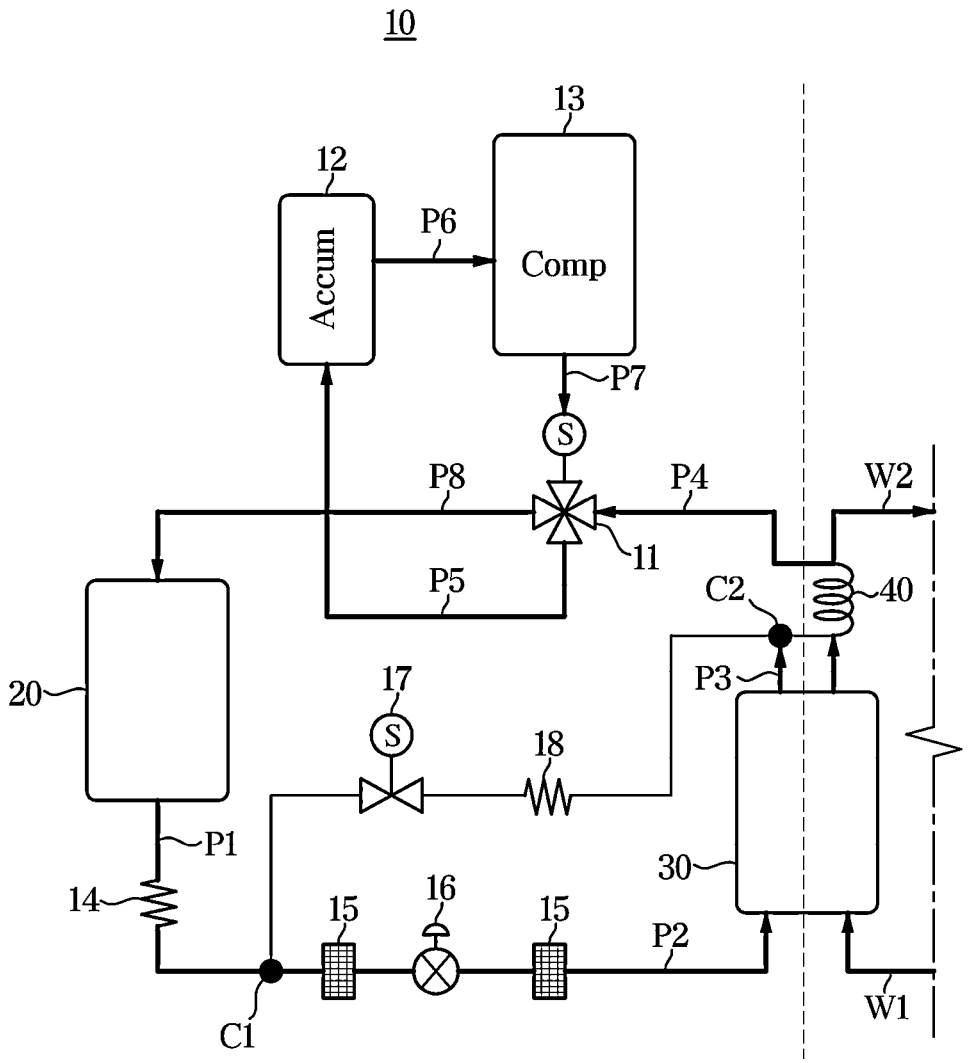
FIG. 3 is a diagram illustrating the flow of refrigerant in the heat pump system during a normal defrosting mode, according to various embodiments.
Figure 4:
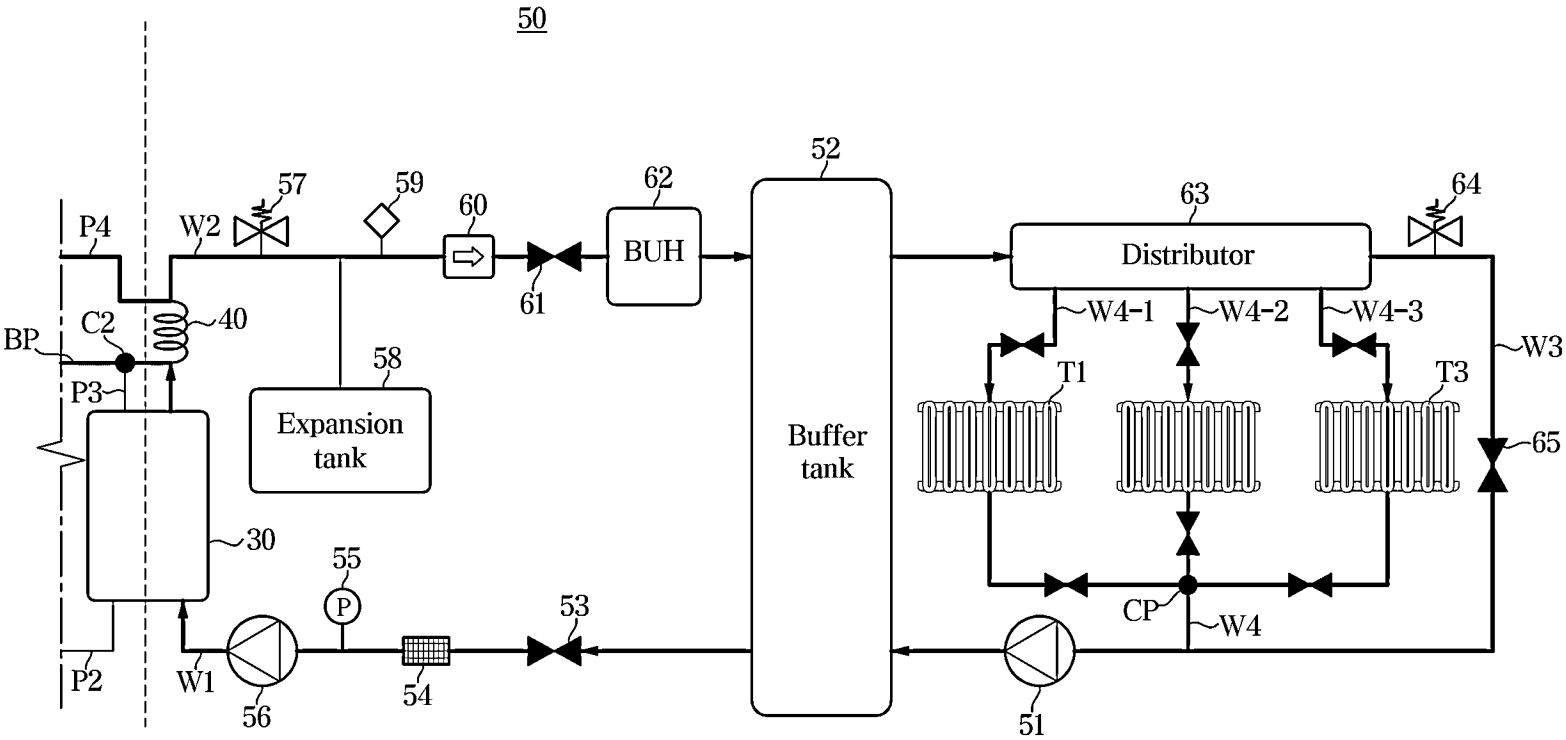
FIG. 4 is a diagram illustrating a flow of water in the heat pump system during the bypass defrosting mode and the normal defrosting mode, according to various embodiments.

FIG. 2 is a diagram illustrating a flow of refrigerant in the refrigerant cycle 10 during a bypass defrosting mode according to various embodiments. FIG. 3 is a diagram illustrating the flow of refrigerant in the refrigerant cycle 10 during a normal defrosting mode according to various embodiments. FIG. 4 is a diagram illustrating a flow of water in the water system cycle 50 during the bypass defrosting mode and the normal defrosting mode according to various embodiments.

Referring to FIGS. 2, 3 and 4 (which may be referred to as FIGS. 2 to 4), the heat pump system 1 (see FIG. 1) may perform different defrosting modes based on the temperature of the water flowing in the first water pipe W1. For example, an operation performed when the temperature of the water flowing in the first water pipe W1 is higher than a predetermined temperature may be defined as a normal defrosting mode. An operation performed when the temperature of the water flowing in the first water pipe W1 is lower than the predetermined temperature may be defined as a bypass defrosting mode. The predetermined temperature may be 15 degrees Celsius.

The defrosting mode may be a mode in which high pressure and high temperature refrigerant flows into the first heat exchanger 20 to prevent and/or reduce frost formation on a surface of the first heat exchanger 20, which may be an outdoor heat exchanger.

Hereinafter, the flow of refrigerant according to each mode will be described in more detail. The refrigerant in the sixth refrigerant pipe P6 may be compressed by the compressor 13 to become a relatively high pressure and high temperature refrigerant. The refrigerant compressed by the compressor 13 may flow into the seventh refrigerant pipe P7 and be guided by the four-way valve 11 through the eighth refrigerant pipe P8 to the first heat exchanger 20.

The first heat exchanger 20 may be an outdoor heat exchanger, and thus, in the defrosting mode, refrigerant at high pressure and high temperature may flow therein to prevent and/or reduce frost formation on the surface of the first heat exchanger 20. The refrigerant heat exchanged in the first heat exchanger 20 may be discharged through the first refrigerant pipe P1. The refrigerant in the eighth refrigerant pipe P8 flowing into the first heat exchanger 20 may be at a relatively higher pressure and higher temperature than the refrigerant in the first refrigerant pipe P1 discharged from the first heat exchanger 20.

In the bypass defrosting mode, the refrigerant flowing in the first refrigerant pipe P1 may flow into the bypass pipe BP through the first end C1 of the bypass pipe BP. In the bypass defrosting mode, the expansion valve 16 may close the second refrigerant pipe P2. In the bypass defrosting mode, the opening/closing valve 17 may open the bypass pipe BP. In the bypass defrosting mode, the opening/closing valve 17 may open the bypass pipe BP to allow the refrigerant to flow. The refrigerant flowing in the bypass pipe BP may be expanded by the second capillary tube 18.

In other words, the refrigerant supplied to the second capillary tube 18 may be at a higher pressure and higher temperature than the refrigerant discharged from the second capillary tube 18. That is, the refrigerant may be depressurized by the second capillary tube 18. The refrigerant with a relatively lower pressure and lower temperature than the refrigerant flowing in the first refrigerant pipe P1 may be guided to the fourth refrigerant pipe P4 through the second end C2 of the bypass pipe BP.

The bypass pipe BP may prevent and/or reduce the low pressure and low temperature refrigerant flowing in the first refrigerant pipe P1 from flowing into the second heat exchanger 30. When the low pressure and low temperature refrigerant flows into the second heat exchanger 30, freezing may occur if the water temperature in the second heat exchanger 30 is low or the flow rate is insufficient. In such a case, the entire heat pump system 1 may need to be replaced due to freezing occurring within the second heat exchanger 30. In other words, the low pressure and low temperature refrigerant that may flow into the second heat exchanger 30 may be directed to the fourth refrigerant pipe P4 by bypassing the second heat exchanger 30. This may and/or reduce freezing within the second heat exchanger 30, which may be the plate heat exchanger 30, and thereby reducing repair and replacement costs of the heat pump system 1.

By the third heat exchanger 40, which may be disposed in the fourth refrigerant pipe P4, the low pressure and low temperature refrigerant flowing in the fourth refrigerant pipe P4 may be heat exchanged with the water flowing in the second water pipe W2 to absorb some of the heat required for defrosting from the water system cycle 50.

In other words, such a configuration may allow the heat pump system 1 to absorb the amount of heat through the third heat exchanger 40 without passing through the second heat exchanger 30, thereby preventing and/or avoiding freezing of the second heat exchanger 30 while obtaining the amount of heat required for defrosting.

The refrigerant flowing in the fourth refrigerant pipe P4 may be directed by diversion of the flow path of the four-way valve 11 to the fifth refrigerant pipe P5, which flows through the accumulator 12 to the sixth refrigerant pipe P6.

In the normal defrosting mode, the refrigerant heat exchanged in the first heat exchanger 20 may flow into the second refrigerant pipe P2 through the first refrigerant pipe P1. In the normal defrosting mode, the expansion valve 16 may open the second refrigerant pipe P2. In the normal defrosting mode, the opening/closing valve 17 may close the bypass pipe BP.

The expansion valve 16 may expand the refrigerant flowing in the second refrigerant pipe P2. In other words, the refrigerant flowing in the second refrigerant pipe P2 may be guided to the second heat exchanger 30 side with its pressure and temperature reduced by the expansion valve 16, and in the second heat exchanger 30, the refrigerant may be heat exchanged with the water flowing from the first water pipe W1. The refrigerant heat exchanged in the second heat exchanger 30 may flow into the fourth refrigerant pipe P4 through the third refrigerant pipe P3.

The refrigerant in the second refrigerant pipe P2 supplied to the second heat exchanger 30 may be at a lower pressure and lower temperature than the refrigerant in the third refrigerant pipe P3 discharged from the second heat exchanger 30. That is, the temperature and pressure of the refrigerant heat exchanged in the second heat exchanger 30 may be increased.

The refrigerant flowing into the fourth refrigerant pipe P4 may be heat exchanged with the water flowing in the second water pipe W2 through the third heat exchanger 40. The refrigerant heat exchanged by the third heat exchanger 40 may absorb heat from the water system cycle 50. The refrigerant heat exchanged in the third heat exchanger 40 may be directed by diversion of the flow path of the four-way valve 11 to flow through the fifth refrigerant pipe P5, and into the compressor 13 through the accumulator 12 and the sixth refrigerant pipe P6.

When a temperature of an inflow water, which is the temperature of the water supplied to the second heat exchanger 30 within the first water pipe W1, is higher than or equal to the predetermined temperature of 15 degrees Celsius, freezing may not occur even though heat exchange is performed in the second heat exchanger 30.

In other words, such a configuration may enable the heat pump system 1, which is capable of performing the bypass defrosting mode and the normal defrosting mode depending on the temperature of the water flowing in the first water pipe W1, to increase the efficiency of the system compared to a heat pump system performing only a single mode.

In the bypass defrosting mode or in the normal defrosting mode, the flow direction of the water in the water system cycle 50 may not differ from each other. In other words, the water in the water system cycle 50 may flow into the second heat exchanger 30 side and be discharged from the second heat exchanger 30 through the second water pipe W2. However, in the bypass defrosting mode, there may be no temperature difference between the water supplied to the second heat exchanger 30 and the water discharged therefrom. In the normal defrosting mode, the water supplied to the second heat exchanger 30 may be at a higher pressure and higher temperature than the water discharged from the second heat exchanger 30.

In addition, in the normal defrosting mode, the water supplied to the third heat exchanger 40 may be at a higher pressure and higher temperature than the water heat exchanged by the third heat exchanger 40.

The water discharged from the second heat exchanger 30 may be heat exchanged with the refrigerant flowing within the fourth refrigerant pipe P4 via the third heat exchanger 40, which is formed to surround the outer circumference 80 (see FIG. 5) of the second water pipe W2.

The refrigerant flowing within the second water pipe W2 after passing through the third heat exchanger 40 may be moved to the second water pipe W2 side, which is connected to the first safety valve 57, the expansion tank 58, the air vent 59, and the flow sensor 60. The refrigerant may then absorb heat from the BUH 62, which is an auxiliary heat source, be guided to the distributor 63 through the buffer tank 52, and then guided to the heat load units T1, T2, and T3. In the defrosting mode, the BUH 62 may transfer the amount of heat that maintains the water temperature to the water flowing in the second water pipe W2. In addition, the buffer tank 52 may be arranged to store the amount of heat to be used for defrosting.

The water that has absorbed heat from the heat load units T1, T2, and T3 may flow to the fourth water pipe W4 at the connection point CP and then be directed to the first water pipe W1. The water in the first water pipe W1 may be pumped by the first pump 51 and directed to the second pump 56 through the buffer tank 52 and the third valve 53. The water in the first water pipe W1 pumped by the second pump 56 may flow back to the second heat exchanger 30.

Figure 5:
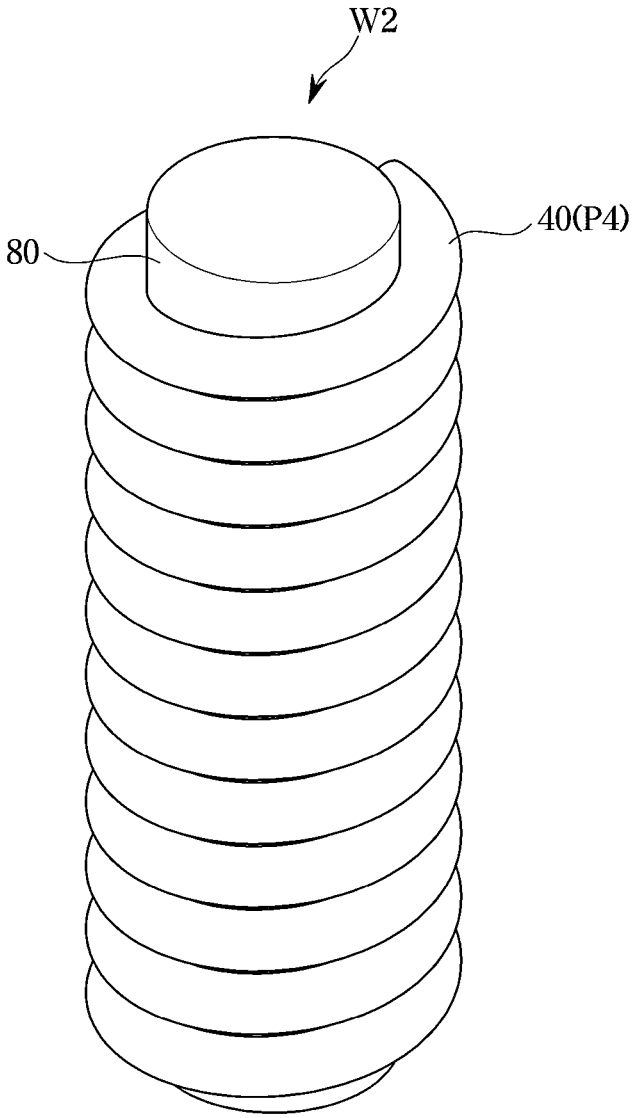
FIG. 5 is a perspective view illustrating a third heat exchanger and a second water pipe of the heat pump system according to various embodiments.

Referring to FIG. 5, the third heat exchanger 40 may be formed to surround the outer circumference 80 of the second water pipe W2. The outer circumference 80 may be the outer circumference 80 of the second water pipe W2. Such a configuration may enable the water flowing in the second water pipe W2 and the refrigerant flowing within the fourth refrigerant pipe P4 to be heat exchanged each other.

The third heat exchanger 40 may be the coil type heat exchanger 40, and the heat exchange rate may vary depending on the material, thickness, and contact area of the coil. A coil with a higher heat exchange rate may reduce the number of times it surrounds the second water pipe W2.

The amount of heat required in the defrosting mode may be approximately 20% of the capacity of the product, and of the 20%, 13% of the amount of heat may be used in the compressor 13, and the remaining 7% may be used in the first heat exchanger 20.

Figure 6:
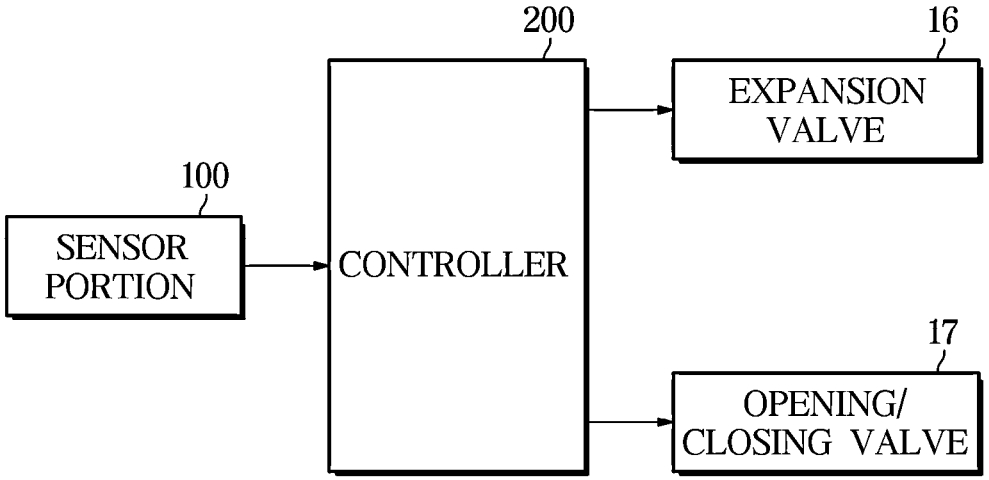
FIG. 6 is a block diagram illustrating an example configuration of a defrosting mode of the heat pump system according to various embodiments.

Referring to FIG. 6, the heat pump system 1 (see FIG. 1) may include a sensor portion (e.g., including a sensor) 100 that measures the temperature of the water flowing in the first water pipe W1, and a controller (e.g., including various circuitry) 200 that operates the expansion valve 16 and the opening/closing valve 17 in accordance with the sensor portion 100.

In other words, the sensor portion 100 may measure the temperature of the inflow water flowing into the second heat exchanger 30 side within the first water pipe W1, and the controller 200 may control the configurations described above differently depending on whether the temperature of the inflow water is higher or lower than the predetermined temperature.

For example, when the inflow water temperature is higher than the predetermined temperature, the controller 200 may cause the expansion valve 16 to open the second refrigerant pipe P2 and cause the opening/closing valve 17 to close the bypass pipe BP according to the normal defrosting mode.

In addition, when the inflow water temperature is lower than the predetermined temperature, the controller 200 may cause the expansion valve 16 to close the second refrigerant pipe P2 and cause the opening/closing valve 17 to open the bypass pipe BP according to the bypass defrosting mode.

Figure 7:
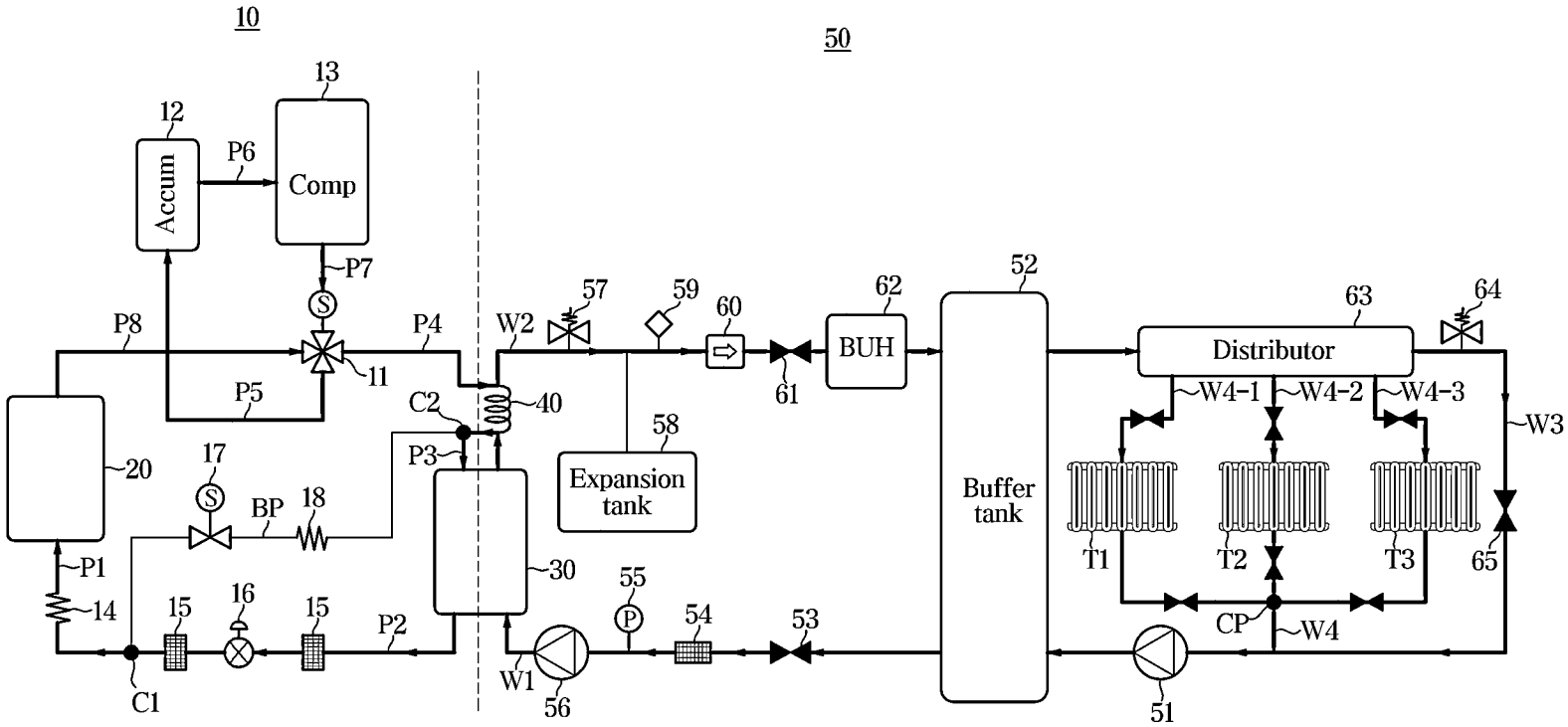
FIG. 7 is a diagram illustrating a flow of refrigerant and water during a heating operation of the heat pump system according to various embodiments.

FIG. 7 is a diagram illustrating the flow of refrigerant and water in a normal heating mode of the heat pump system 1 according to various embodiments.

Referring to FIG. 7, air, which is an external heat source, and refrigerant may be provided to be heat exchanged in the first heat exchanger 20. The first refrigerant pipe P1 that supplies refrigerant to be heat exchanged in the first heat exchanger 20 and the eighth refrigerant pipe P8 that discharges refrigerant heat exchanged in the first heat exchanger 20 may be located adjacent to the first heat exchanger 20. The refrigerant flowing in the eighth refrigerant pipe P8 may be at a relatively higher pressure and higher temperature than the refrigerant flowing in the first refrigerant pipe P1. The refrigerant in the eighth refrigerant pipe P8 may flow into the accumulator 12 through the fifth refrigerant pipe P5 by the four-way valve 11, and flow into the compressor 13 through the sixth refrigerant pipe P6. The refrigerant compressed by the compressor 13 may be directed to the fourth refrigerant pipe P4 by the four-way valve 11 through the seventh refrigerant pipe P7.

The refrigerant flowing in the fourth refrigerant pipe P4 may be heat exchanged with the water flowing in the second water pipe W2 by the third heat exchanger 40. The refrigerant heat exchanged by the third heat exchanger 40 may be supplied to the second heat exchanger 30 via the third refrigerant pipe P3. Thereafter, the refrigerant heat exchanged in the second heat exchanger 30 may flow into the second refrigerant pipe P2 and then flow into the first refrigerant pipe P1 toward the first heat exchanger 20 side.

The pressure and temperature of the refrigerant flowing in the fourth refrigerant pipe P4, the third refrigerant pipe P3, and the second refrigerant pipe P2 may decrease sequentially. This is because heat is transferred from the refrigerant cycle 10 to the water system cycle 50 by the third heat exchanger 40 and the second heat exchanger 30.

The pressure and temperature of: the water in the first water pipe W1, the water in the second water pipe W2 flowing into the third heat exchanger 40 side, and the water in the second water pipe W2 discharged from the third heat exchanger 40 may increase sequentially.

The water in the second water pipe W2 heat exchanged by the second heat exchanger 30 and the third heat exchanger 40 may supply heat to the heat load units T1, T2, and T3. The water in the fourth water pipe W4 and the third water pipe W3 that is returned after providing heat to the heat load units T1, T2, and T3 may be supplied back to the first heat exchanger 30 side through the first pump 51 and the second pump 56.

Figure 8:
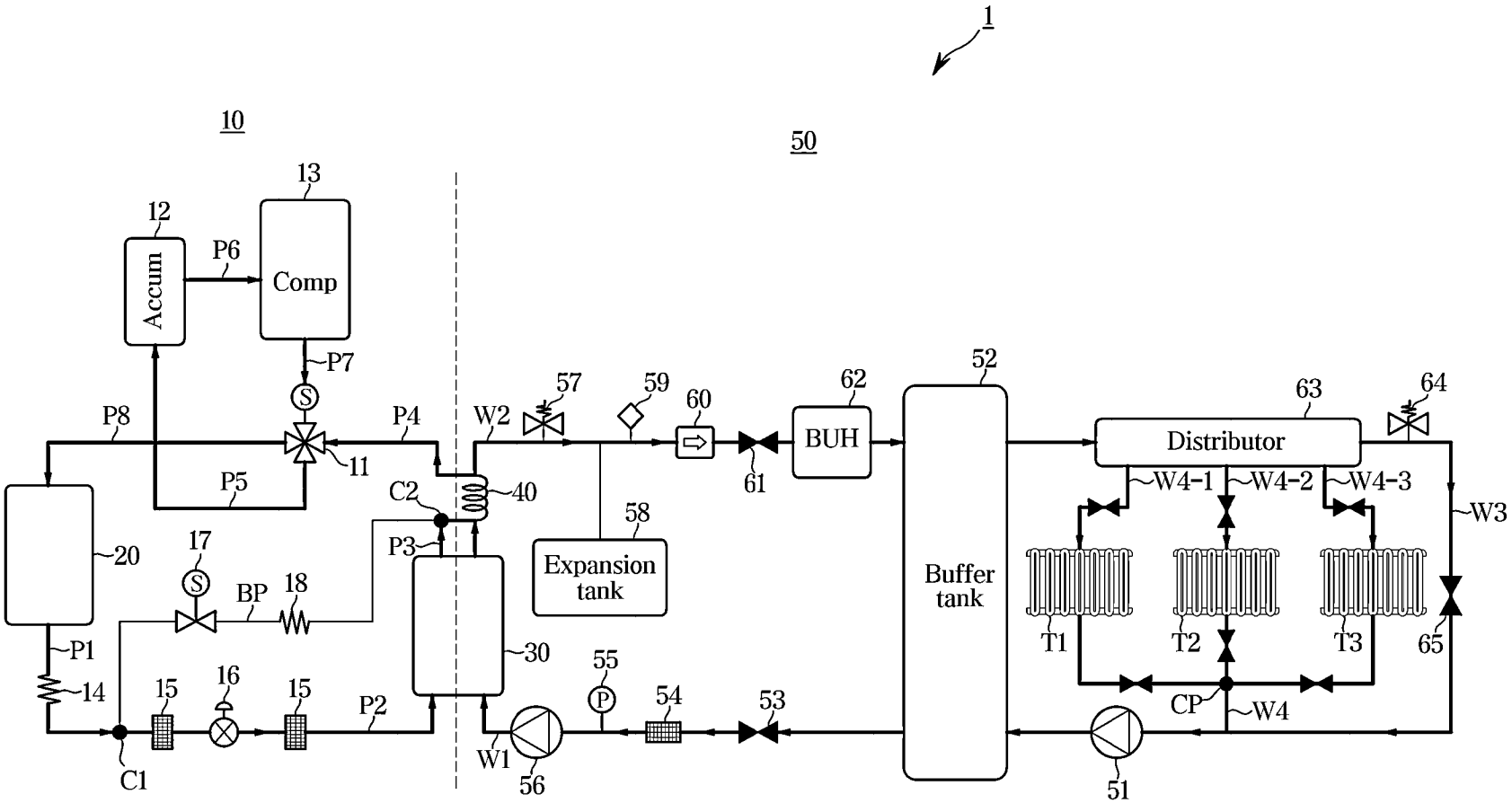
FIG. 8 is a diagram illustrating a flow of refrigerant and water during a cooling operation of the heat pump system, according to various embodiments.

FIG. 8 is a diagram illustrating the flow of refrigerant and water in a normal cooling mode of the heat pump system 1 according to various embodiments.

Referring to FIG. 8, air, which is an external heat source, and refrigerant to be heat exchanged in the first heat exchanger 20 may be provided. In other words, the high pressure and high temperature refrigerant compressed in the compressor 13 may be supplied to the first heat exchanger 20 side via the seventh refrigerant pipe P7 and the eighth refrigerant pipe P8 by diverting the flow path of the four-way valve 11.

The refrigerant heat exchanged in the first heat exchanger 20 may be discharged into the first refrigerant pipe P1. The refrigerant flowing in the first refrigerant pipe P1 may flow into the second refrigerant pipe P2 and in turn flow into the second heat exchanger 30 with its pressure reduced by the expansion valve. The refrigerant that has been heat exchanged with the water in the water system cycle 50 in the second heat exchanger 30 may flow into the third refrigerant pipe P3 and the fourth refrigerant pipe P4 side.

While passing through the fourth refrigerant pipe P4, the refrigerant may absorb heat from the water flowing in the second water pipe W2 by the third heat exchanger 40. According to such a structure, the temperature of the refrigerant flowing in the second refrigerant pipe P2, the third refrigerant pipe P3, and the fourth refrigerant pipe P4 may be sequentially increased. The refrigerant heat exchanged in the third heat exchanger 40 may be directed to the four-way valve 11 side at a relatively higher pressure and higher temperature than the refrigerant in the third refrigerant pipe P3.

The refrigerant in the fourth refrigerant pipe P4 may pass through the fifth refrigerant pipe P5, the accumulator 12, and the sixth refrigerant pipe P6 by the four-way valve 11, and may be pressurized again by the compressor 13.

For the water system cycle 50, in the cooling mode, the water in the first water pipe W1 may be directed through the second heat exchanger 30 and the third heat exchanger 40 to the second water pipe W2 with a reduced pressure and temperature. Thereafter, the water in the second water pipe W2 may pass through the distributor 63 to transfer cold water to the heat load units T1, T2, and T3, and the water heat exchanged by the heat load units T1, T2, and T3 may be directed to the water pipe W4. The water in the fourth water pipe W4 and the third water pipe W3 may be directed back to the first water pipe W1 and supplied to the first heat exchanger 30 by the first pump 51 and the second pump 56.

In other words, as can be seen in FIGS. 7 and 8, the refrigerant cycle 10 and the water system cycle 50 may be heat exchanged through the third heat exchanger 40 even when in the heating mode or cooling mode. Such a configuration may increase efficiency not only in the defrosting mode but also in the heating mode or cooling mode.

While the disclosure has been illustrated and described with reference to various example embodiments, it will be understood that the various example embodiments are intended to be illustrative, not limiting. It will be further understood by those skilled in the art that the present disclosure is not limited to the above-described embodiments, and various changes and modifications may be made without departing from the true spirit and full scope of the disclosure, including the appended claims and their equivalents. It will also be understood that any of the embodiment(s) described herein may be used in conjunction with any other embodiment(s) described herein.

What is claimed is:

1. A heat pump system, comprising:

a compressor configured to compress a refrigerant;

a first heat exchanger configured to exchange heat between the refrigerant and air;

a second heat exchanger configured to exchange heat between the refrigerant and water;

a first refrigerant pipe configured to discharge the refrigerant heat exchanged in the first heat exchanger during a defrosting operation for the first heat exchanger;

a second refrigerant pipe configured to guide the refrigerant from the first refrigerant pipe to the second heat exchanger;

a third refrigerant pipe configured to discharge the refrigerant heat exchanged in the second heat exchanger after flowing into the second heat exchanger through the second refrigerant pipe;

a first water pipe configured to supply water to be heat exchanged in the second heat exchanger;

a second water pipe configured to return the water heat exchanged in the second heat exchanger;

a bypass pipe configured to bypass the second heat exchanger, including a first end connected to the first refrigerant pipe and a second end connected to the third refrigerant pipe; and a third heat exchanger configured to heat exchange the refrigerant guided by the bypass pipe and introduced through the second end of the bypass pipe with the water flowing in the second water pipe during the defrosting operation.

2. The heat pump system of claim 1, further comprising a fourth refrigerant pipe connected to the bypass pipe on one side of the bypass pipe, and configured to allow the refrigerant heat exchanged by the third heat exchanger to be moved to the compressor side.

3. The heat pump system of claim 2, wherein the third refrigerant pipe is connected to the fourth refrigerant pipe on an upstream side of the third heat exchanger and configured to allow the refrigerant discharged from the third refrigerant pipe to pass through the third heat exchanger.

4. The heat pump system of claim 1, further comprising:

a capillary tube disposed in the bypass pipe and configured to expand the refrigerant flowing in the bypass pipe, and an opening/closing valve configured to open and/or close the bypass pipe.

5. The heat pump system of claim 4, wherein the opening/closing valve is disposed on an upstream side of the capillary tube with respect to a direction of movement of the refrigerant flowing in the bypass pipe.

6. The heat pump system of claim 4, wherein the opening/closing valve includes a solenoid valve.

7. The heat pump system of claim 2, further comprising an expansion valve configured to expand the refrigerant flowing in the second refrigerant pipe and capable of opening and/or closing the second refrigerant pipe, wherein the bypass pipe has a first end connected to the first refrigerant pipe between the first heat exchanger and the expansion valve, and a second end connected to the third refrigerant pipe and the fourth refrigerant pipe between the second heat exchanger and the third heat exchanger.

8. The heat pump system of claim 7, further comprising a capillary tube provided in the first refrigerant pipe.

9. The heat pump system of claim 1, wherein the third heat exchanger includes a coil heat exchanger surrounding an outer circumference of the second water pipe.

10. The heat pump system of claim 1, wherein the heat pump system is configured to perform different defrosting modes based on the temperature of the water flowing in the first water pipe.

11. The heat pump system of claim 10, wherein a bypass defrosting mode is configured to be performed based on the temperature of the water flowing in the first water pipe being lower than a specified temperature, and based on the heat pump system being in the bypass defrosting mode, the refrigerant in the first refrigerant pipe is directed to the third heat exchanger through the bypass pipe.

12. The heat pump system of claim 11, wherein based on the heat pump system being in the bypass defrosting mode, the second refrigerant pipe is closed and the refrigerant in the bypass pipe is expanded by a capillary tube.

13. The heat pump system of claim 10, wherein a normal defrosting mode is configured to be performed based on the temperature of the water flowing in the first water pipe being greater than a specified temperature, and based on the heat pump system being in the normal defrosting mode, the refrigerant in the first refrigerant pipe is directed to the second heat exchanger through the second refrigerant pipe.

14. The heat pump system of claim 13, wherein based on the heat pump system being in the normal defrosting mode, the bypass pipe is closed and the refrigerant in the second refrigerant pipe is expanded by an expansion valve.

15. The heat pump system of claim 1, wherein the first heat exchanger includes a finned tube heat exchanger, and the second heat exchanger includes a plate heat exchanger.

16. A heat pump system, comprising:

a compressor configured to compress a refrigerant;

a first heat exchanger configured to exchange heat between the refrigerant and air;

a second heat exchanger configured to exchange heat between the refrigerant heat exchanged by the first heat exchanger and water;

a first water pipe configured to guide water to heat exchange in the second heat exchanger;

a second water pipe configured to guide the water heat exchanged in the second heat exchanger to the outside;

a first refrigerant pipe configured to discharge the refrigerant heat exchanged in the first heat exchanger during a defrosting operation for the first heat exchanger;

a second refrigerant pipe connected to the first refrigerant pipe and configured to guide the refrigerant in the first refrigerant pipe to the second heat exchanger;

a third refrigerant pipe configured to discharge the refrigerant heat exchanged in the second heat exchanger;

a bypass pipe having a first end connected to the first refrigerant pipe and a second end connected to the third refrigerant pipe and configured to bypass the second heat exchanger; and a fourth refrigerant pipe connected to the second end of the bypass pipe to guide refrigerant introduced through the second end of the bypass pipe and including a third heat exchanger configured to exchange heat with the water flowing in the second water pipe, wherein the refrigerant flowing in the first refrigerant pipe is guided to the second refrigerant pipe or the bypass pipe.

17. The heat pump system of claim 16, wherein further comprising:

a capillary tube disposed in the bypass pipe and configured to expand the refrigerant flowing in the bypass pipe, and an opening/closing valve configured to open and close the bypass pipe.

18. The heat pump system of claim 16, wherein further comprising:

an expansion valve configured to expand the refrigerant flowing in the second refrigerant pipe and capable of opening and closing the second refrigerant pipe, wherein the first end of the bypass pipe is connected to the first refrigerant pipe between the first heat exchanger and the expansion valve, and the second end of the bypass pipe is connected to the third refrigerant pipe and the fourth refrigerant pipe between the second heat exchanger and the third heat exchanger.

19. The heat pump system of claim 16, wherein the third heat exchanger comprises:

a coil heat exchanger surrounding an outer circumference of the second water pipe.

20. A heat pump system, comprising:

a compressor configured to compress a refrigerant;

a first heat exchanger configured to heat exchange between the refrigerant and air, a second heat exchanger configured to heat exchange between the refrigerant and water;

a first refrigerant pipe configured to discharge the refrigerant heat exchanged in the first heat exchanger during a defrosting operation for the first heat exchanger;

a second refrigerant pipe configured to guide the refrigerant from the first refrigerant pipe to the second heat exchanger;

a third refrigerant pipe configured to discharge the refrigerant heat exchanged in the second heat exchanger;

an expansion valve configured to expand the refrigerant flowing in the second refrigerant pipe and to open and close the second refrigerant pipe;

a first water pipe configured to supply water to be heat exchanged in the second heat exchanger;

a second water pipe configured to return the water heat exchanged in the second heat exchanger;

a third heat exchanger configured to exchange heat between the refrigerant with the water flowing in the second water pipe during the defrosting operation; and a bypass pipe including a first end connected to the first refrigerant pipe and a second end connected to the third refrigerant pipe and configured to bypass the second heat exchanger and guide the refrigerant heat exchanged by the first heat exchanger to the third heat exchanger side through the second end of the bypass pipe during the defrosting operation.

* * * * *